US005704384A

United States Patent [19]

Tisbo et al.

[11] Patent Number: 5,704,384

[45] Date of Patent: Jan. 6, 1998

[54] STACKABLE HOSE REEL CART WITH TRAY

[75] Inventors: Thomas A. Tisbo, Barrington Hills; Stephen P. Whitehead, Elgin; Michael G. Uffner, Naperville, all of Ill.

[73] Assignee: Suncast Corporation, Batavia, Ill.

[21] Appl. No.: 514,211

[22] Filed: Aug. 11, 1995

[51] Int. Cl.[6] ..... B65H 75/34

[52] U.S. Cl. ..... 137/15; 137/315; 137/355.27; 242/395.1; 242/403.1

[58] Field of Search ..... 137/15, 315, 355.26, 137/355.27; 242/403.1, 395.1

[56] References Cited

U.S. PATENT DOCUMENTS

| | | | |
|---|---|---|---|
| 4,512,361 | 4/1985 | Tisbo et al. | 137/355.27 |
| 4,913,580 | 4/1990 | Whitehead | 403/326 |
| 5,007,598 | 4/1991 | Spear et al. | 137/355.27 |
| 5,046,520 | 9/1991 | Sanchez et al. | 137/355.27 |
| 5,056,553 | 10/1991 | Whitehead et al. | 137/355.27 |
| 5,425,391 | 6/1995 | Tisbo et al. | 137/355.27 |

FOREIGN PATENT DOCUMENTS

| | | | |
|---|---|---|---|
| 5382 | 4/1886 | United Kingdom | 242/395.1 |

*Primary Examiner*—A. Michael Chambers
*Attorney, Agent, or Firm*—McHale & Slavin

[57] ABSTRACT

The hose cart with tray of the present invention is of a shape and design allowing preassembly thereby eliminating the need for instruction manuals and associated product packaging necessary of hose carts that are sold in an unassembled state. The hose cart employs a single unitary frame for support of a flexible garden hose to be wound into a coil of multiple layers by use of a directional stress relieving hose reel spool. Reel flanges are oblong shaped for holding of the hose within the formed spool yet providing the nesting ability for assembled carts. A handle is foldable for storage with locks concealed within the base of the handle, and a foldable storage tray which is pivotally attached to a bracket mounted to the handle crossbar. Syringe type hub attachments are further disclosed for removal and maintenance of the water seals without tools. A crank is provided for rotation of the spool utilizing a collapsible handle for windably holding an elongated flexible garden hose, the crank can be attached to the side of the apparatus allowing left or right hand operation.

25 Claims, 9 Drawing Sheets

STACKABLE HOSE REEL CART WITH TRAY

FIELD OF THE INVENTION

This invention relates to the storage of flexible garden hoses and, more particularly, to an improved portable hose cart that can be preassembled and shipped in a stacked array having an integrated holding tray.

BACKGROUND INFORMATION

Portable hose carts for convenient handling and storage of a flexible garden hose have gained wide public acceptance. Such carts are primarily constructed of molded plastic components having a centrally disposed rotatable spool for reeling inward or outward the flexible hose, a frame including a pair of frame sides for supporting the spool, wheels at one end of the base of the frame, and a handle for tilting the frame onto the wheels so that the cart may be easily moved. For more information concerning the structure and operation of such a hose cart, reference may be made to U.S. Patent Re. 32,510 and U.S. Pat. No. 5,425,391, the teachings of which are hereby incorporated by reference.

Hose carts are commonly purchased by the general consumer wherein it is desirable that the hose cart can be easily assembled using minimal hand tools. The use of such fasteners can be time consuming and requires the use of hand tools. Commercially available hose carts typically make extensive use of threaded fasteners to join major components. U.S. Pat. No. 4,913,580 teaches the use of a connector assembly for joining components of a hose cart. A male component of the assembly is molded with one piece of the cart, and a female component of the assembly is molded with a second piece of the cart to be joined to the first piece. These components are easily unlatched to permit disassembly of the hose cart.

A problem with portable hose carts of the prior art is that, despite the directions for assembly, a majority of the consuming public is unable or have no desire to assemble such devices. Cottage industries have developed solely for the purpose of assembling products that have been purchased in a disassembled state. Many stores that inventory unassembled product have personnel on staff capable of assembling the product for the customer. If the store performs this assembly at no charge to the customer, it is a burden on the store. Alternatively, the store may assemble the product and pass the cost onto the consumer.

One of the problems with any assembly outside of the factory is that improper assembly can damage the product. This typically occurs when the assembler does not read the instructions or tries to force fit a component. The result is aggravation by the purchaser who may ask the store to take back the product and refund their money. Obtaining a refund is a time consuming and expensive process to both the store and the producing factory. The store may return the product to the factory who then attempts to salvage the damaged product. Not unexpectedly, most returned items are damaged as a result of improper assembly.

Most large products produced by a manufacturer are not assembled due to the size of the packaging required once an assembled product is put into an operating form. For instance, a typical hose cart is shipped in a disassembled state so that it can fit in a box that allows the device to be shipped on a pallet together with numerous other boxes. Under such circumstances it is not unusual to have ten or more boxes of portable hose reels placed on a pallet wherein a forklift can be used for lifting of the pallet for placement.

A receiving store may leave a shipment of boxed hose carts on a shipping pallet above the normal reach of the consuming public. Boxed product is brought down to replenish those items purchased causing the store to decide whether or not to assemble the product before display.

Unassembled hose carts are packaged in a shipping carton to protect the product during shipping and storage, and more importantly, prevent loss of individual components before assembly. A great deal of time and expense goes into packaging of the product so as to provide as compact packaging as possible. The shipping carton must include indicia to indicate to the public what is within the contents of the carton. Adding an expense to the carton is the use of color graphics which is preferred by store owners so that potential purchasers do not break open the cartons in an effort to determine the contents of the carton. The unassembled hose carts further require the inclusion of assembly instructions.

Disposal of shipping containers is also wasteful. Once a hose cart is assembled, the shipping carton is unusable for nearly any other purpose. The carton becomes a waste product that will hopefully be recycled but realistically adds mass to a landfill. U.S. Pat. No. 4,512,361; U.S. Pat. No. 5,046,520 and U.S. Pat. No. 5,056,553 all set forth hose cart storage apparatuses which consist of various preassembled components that are easily assembled upon receipt by the average consumer. Common among these devices is the need for shipping cartons so that the components are not lost in transit. Thus, despite the simplicity of the assembly, all such devices are dependent upon the use of properly sized shipping cartons which further require graphics so as the consumer can determine the contents of the carton.

Another problem with the prior art hose cart device is the securement of a reel hub necessary for the introduction of water. The reel hub must allow rotation yet allow the device to be hooked up to a water supply wherein the hose can be reeled inward or outward without interfering with the flow of water. Seals within the hub allow rotation without leakage. The problem occurs when the seals require service, either in the form of lubrication or replacement. This is a common problem in the northern states should the device be allowed to freeze. As exemplified by the '361 and '520 patents, the hub is coupled to the reel by the use of fasteners such as a metal screw. When the seals require service, the hub must be removed to facilitate replacement. Without proper tools, the unit will be damaged. Should the attachment screws be displaced, the use of improperly sized substitutes may cause the screw threads to strip, damaging the unit. The necessity of tools may intimidate the average consumer from performing even routine maintenance such as lubrication, leading to early failure of the seals.

Another problem with the prior art is that the winding reels do not accommodate the natural curvature of a hose connection which may lead to a premature failure of the hose. To compensate for the curvature, prior art devices employ an extension pipe to direct the water supply to a position external the hub surface. Without such piping, should a flexible hose be wrapped around the reel, the hose is forced into a position placing the hose in a stressed or kinked position.

Further, the use of a tray for holding items is most beneficial allowing an individual to change nozzles or hold items off the ground. While such trays are known in the art, the use of a tray on stackable hose reel is not known in the art, the use of which requires proper retention so as to avoid interfering with an ability to stack such hose reels.

Thus, what is lacking in the art is a portable hose cart that can be preassembled at the factory, shipped without the necessity of a conventional shipping container, and of such design that the carts can be nested together to reduce storage space. Further, a portable hose cart is needed having an improved reel assembly that can be disassembled without tools and includes a means for reducing stress from a hose wrapped around the reel as well as provide a tray storage area that is shipped in a folded position to prevent interference with storage or shipping.

SUMMARY OF THE INVENTION

Among the several aspects and features of the present invention may be noted the provision of an improved portable garden hose cart. The hose cart of the present invention is of a shape and design so that the hose cart may be preassembled at the factory thereby eliminating the need for instruction manuals and associated product packaging. The teaching of the instant invention allows for a plurality of preassembled portable hose carts to be placed upon a skid decreasing the amount of space necessary for storage and transportation thereby increasing the number of units that can be shipped per a given cubic volume of space. In order to accomplish efficiency in shipping and the elimination of shipping cartons, the instant invention incorporates the use of foldable handles having an integrated tray, an oblong shaped reel flange, and a one-piece inverted V-shaped frame so as to permit nesting of multiple units.

Preassembling of the hose reel cart of the instant invention permits the use of a single unitary frame construction for support of a flexible garden hose to be wound into a coil of multiple layers with adjacent turns of each layer touching each other by use of a directional reel forming a spool rotatably coupled to the frame. Reel flanges forming the side walls of the spool are oblong shaped for holding of the hose within the spindle of the reel in a similar manner as the prior art, yet allowing for the aforementioned nesting of assembled hose carts.

The surface of the reel used for winding of the hose includes a provision for coupling to an end of the hose in such a manner as to reduce or eliminate stress normally placed on the flexible hose eliminating the need for a water extension pipe. The reel surface has a ramped directional cavity allowing for placement of a hose further adding a directional aspect for the hose. The cavity allows winding of a hose in a clockwise or counter clockwise direction. The flexible hose is wound around the reel by use of a hand crank coupled through a hub providing a direct rotational link between the crank and the winding of the spool. During non-use a handle on the crank is placed in a storage position by pivoting the handle about one end of the crank so as to place the handle in a position perpendicular to the crank. The crank can be positioned on either side of the frame providing a left or right handed operation. Despite the unit being preassembled by the factory, this interchangeable feature allows a water connector to be easily removed from the hub by depressing a syringe type pulling mechanism surrounding the connector to release tabs biased on the inside of the hub. The quick release water connector provides ease of access to internal sealing O-rings should they need maintenance.

The hose reel includes a foldable tray that does not interfere with the storage or stacking ability of the device. The foldable tray having a latch mechanism for locking the tray in position, the tray having a plurality of through holes for drainage.

Thus, an objective of the instant invention is to provide a portable hose cart with an integrated storage tray having a one piece frame with all components preassembled so as to eliminate the need for packaging and instruction manuals commonly used in the prior art.

Yet another objective of the instant invention is to provide a portable hose cart that can be stacked on top of similar hose carts in a nesting fashion teaching the ability to ship more units per cubic foot volume than possible with the prior art if packaged individually even in a completely disassembled state.

Another objective of the instant invention is to disclose the use of quick release locking tabs that allow the crank of a winding spool to be placed on either side of the frame permitting left or right handed operation.

Yet another objective of the instant invention is to provide a functional cross support in the handle allowing a reduction in the mass of the handle and further providing a means for holding the free end of a flexible hose in an upright position so as to prevent water dripping during storage.

Yet still another objective of the instant invention is to provide a water connector that can be installed and removed without the use of hand tools. In particular, the connector will use a syringe type attachment mechanism that engages tabs on the inner surface of the hub to be disengaged for access to replaceable O-rings.

Still another objective of the invention is to teach the use of a handle locking mechanism that eliminates the need for a hook pin and can be incorporated into the frame of a portable hose cart wherein it can be positioned so as not to cause accidental release.

Still another objective of the invention is to teach the use of a foldable tray that is integrated into a foldable handle. The tray using a living hinge with a latch for locking into a fixed position.

Other objects and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENT

Figure 1:
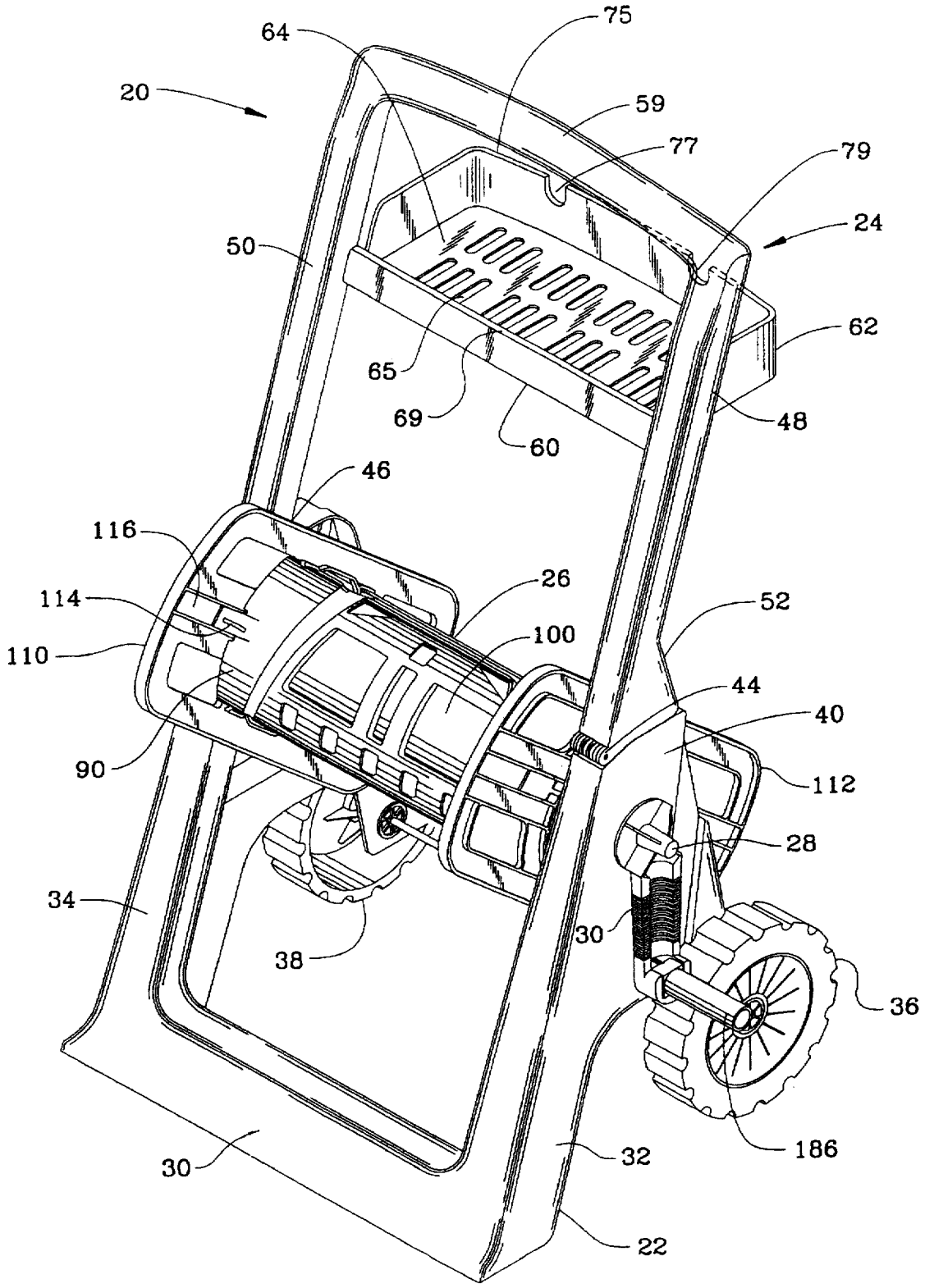
FIG. 1 is a perspective view of a portable hose cart with a pivoting tray in the handle embodying various aspects of the present invention.
Figure 2:
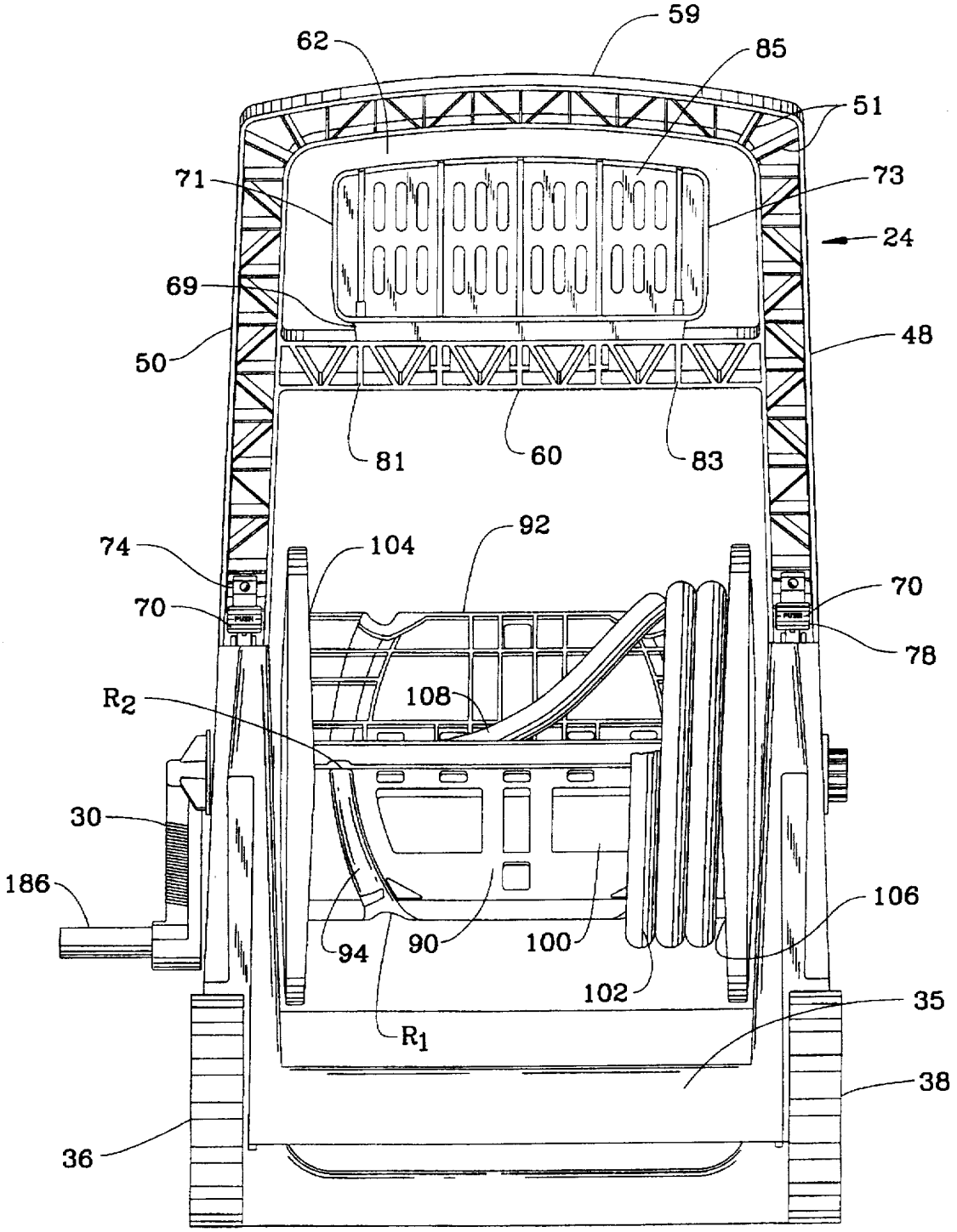
FIG. 2 is a rear view of the portable hose cart with the pivoting tray in a stored position.
Figure 2A:
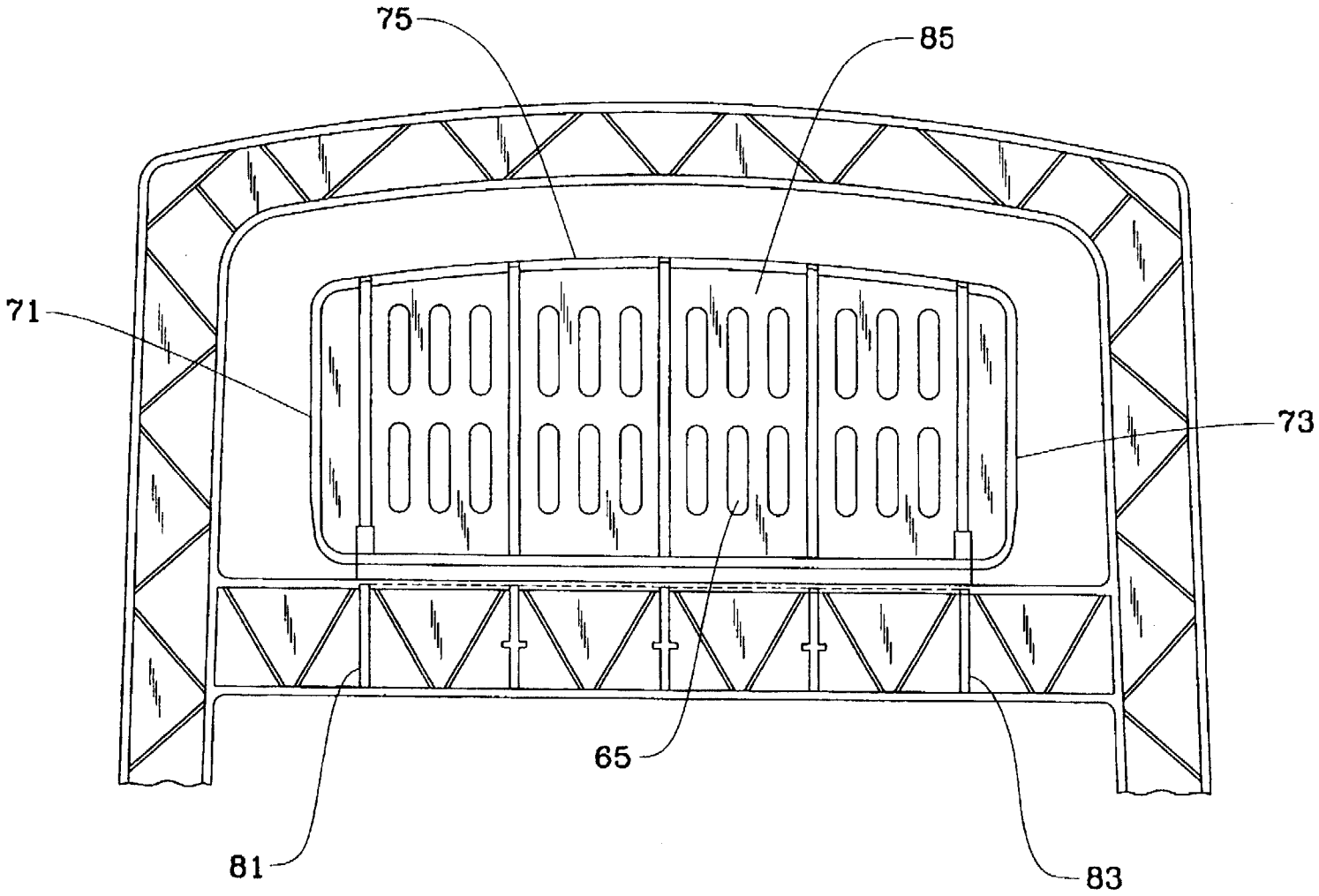
FIG. 2A is an enlarged view of the tray illustrated in FIG. 2.
Figure 3:
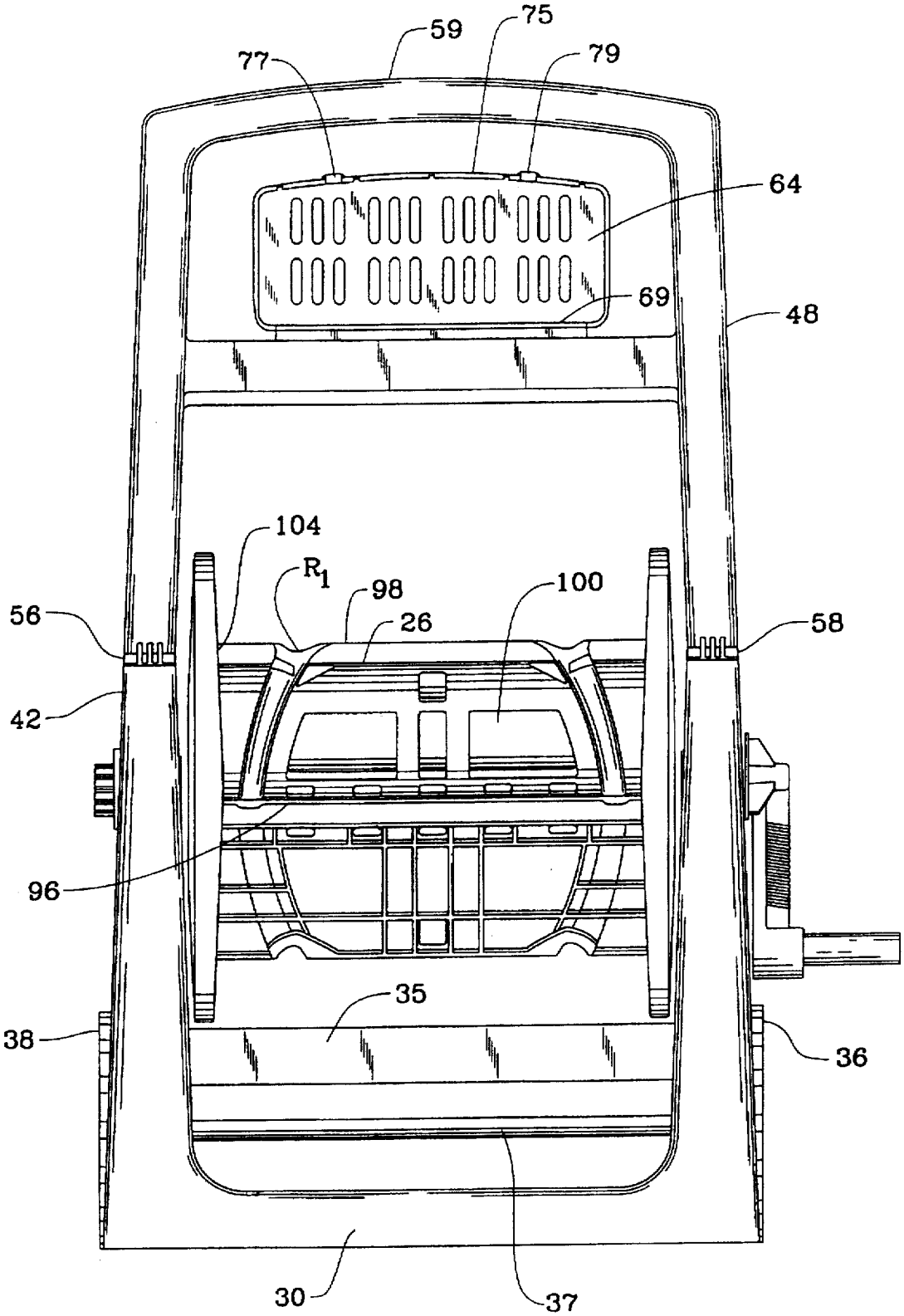
FIG. 3 is a front view of the portable hose cart with the tray in a stored position.
Figure 4:
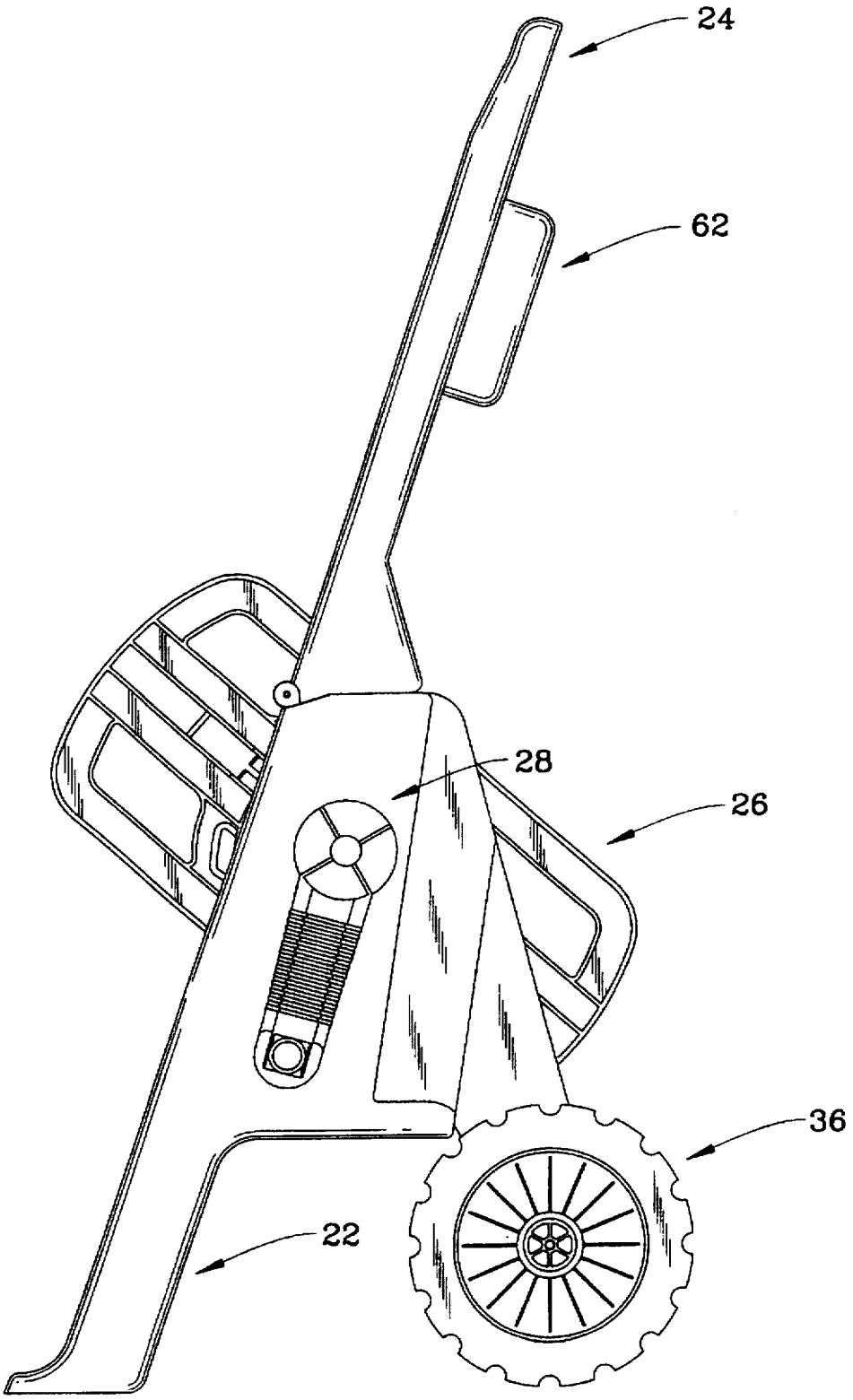
FIG. 4 is a side elevational view of the portable hose cart of FIG. 1.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Referring now to FIGS. 1 through 4, illustrated is the hose storage apparatus embodying the present invention, generally indicated by numeral 20. The major components of the hose storage apparatus include a frame 22 having a collapsible handle 24 supporting a reel 26 rotatably mounted to the frame. The reel 26 is rotated by use of a crank 28 coupled to the reel which permits rotating of the reel for purposes of winding a flexible hose onto the reel. Tray 62 provides a support platform when placed in an open position.

The frame 22 consists of a one-piece molded plastic frame, such as polyethylene, defined by a front crossbar 30 molded to the front legs of inverted V-shaped frame sides 32 and 34. Rear crossbar 35 is molded to the back legs of the frame sides further providing support for wheels 36 and 38 rotatably coupled by axle 37 for ease of transfer by pivoting the weight of the hose reel onto the wheels thereby permitting the operator to pull or push the apparatus effortlessly.

Frame sides 32 and 34 form a mirror image and include a hub shape and design allowing for the interchangability of a hub coupling device, namely a crank and hose connector as described in detail later in this specification. Upper portion 40 of frame side 32 and an upper portion 42 of frame side 34 is substantially flat with pivot ears 44 and 46 available for connecting to the handle 24. Pivot ears 44 and 46 are formed integrally with said upper portions 40 and 42 of their respective frame sides 32 and 34.

Handle 24 is generally U-shaped and constructed of a single piece of plastic such as polyethylene with ribbed reinforcement 51 along the rear of the handle. The handle 24 is further defined by a pair of lateral bars 48 and 50 each of which have an enlarged base conforming to the upper portions 40 and 42 of the frame 22. Each base includes a pivot ear 56 and 58 operatively associated with the frame pivot ears 44 and 46 allowing pivotable rotation of the handle about the front surface of the frame sides. By release of locking mechanisms 70, the handle is available to pivot about the frame 22 for storage in a flat position against the front surface of frame sides 32 and 34. When the apparatus is not in a storage position, the lifting of the handle 24 into an upright position will engage the locking mechanisms 70 causing the handle 24 to lock in an upright position biased against the upper portion of the frames sides. As shown by illustration, the base of the handle is enlarged conforming to the upper portions of the frame sides so that when the apparatus is being transported, the handle provides stability in structure and provides leverage ability should undue weight be present.

Figure 5:
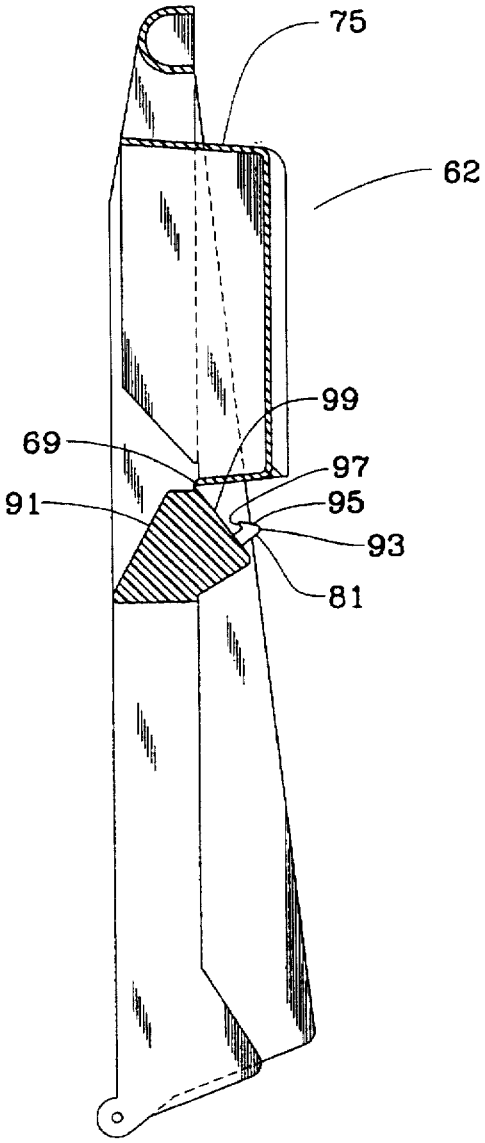
FIG. 5 is an enlarged view of the handle and tray illustrated in FIG. 4.

Referring also to FIG. 5, the tray 62, is molded to extend upwards from crossbrace 60 during a storage position and includes floor 64 having a plurality of openings 65 for water drainage. The floor 64 has a hinge wall 67 which secures the tray to the crossbar by use of a living hinge 69 constructed of plastic having a predefined fold line. The tray 62 includes first side wall 71, second side wall 73, and end wall 75. End wall 75 further includes detentes 77 and 79 for use in securing a hose along the end wall to prevent back draining when the hose is not in use. Hook latch 81 and 83 project from the rear of cross brace 60 for engaging the lower surface 85 of the tray 62.

Locks 70 releasably secure the handle 24 to the frame 22 in an upright position. The lock base is secured to its respective portion of the handle lock screw 74. The lock base has a resilient section formed integral therewith. A push plate 78 is also formed integrally with the resilient section. A lip formed along the bottom end of the lock is available for engaging a respective lock opening formed in the upper portion of each frame side 32 and 34. The bottom of the lip is rounded so as to assist in deflection during the locking stage by sliding over an engagement surface formed on one end of an opening (not shown) of the frame 22. This latching mechanism is fully detailed in FIGS. 7–9 of the incorporated-by-reference U.S. Pat. No. 5,425,391. Further, the placement of the lock within the handle base prevents accidental release of the lock.

Figure 6:
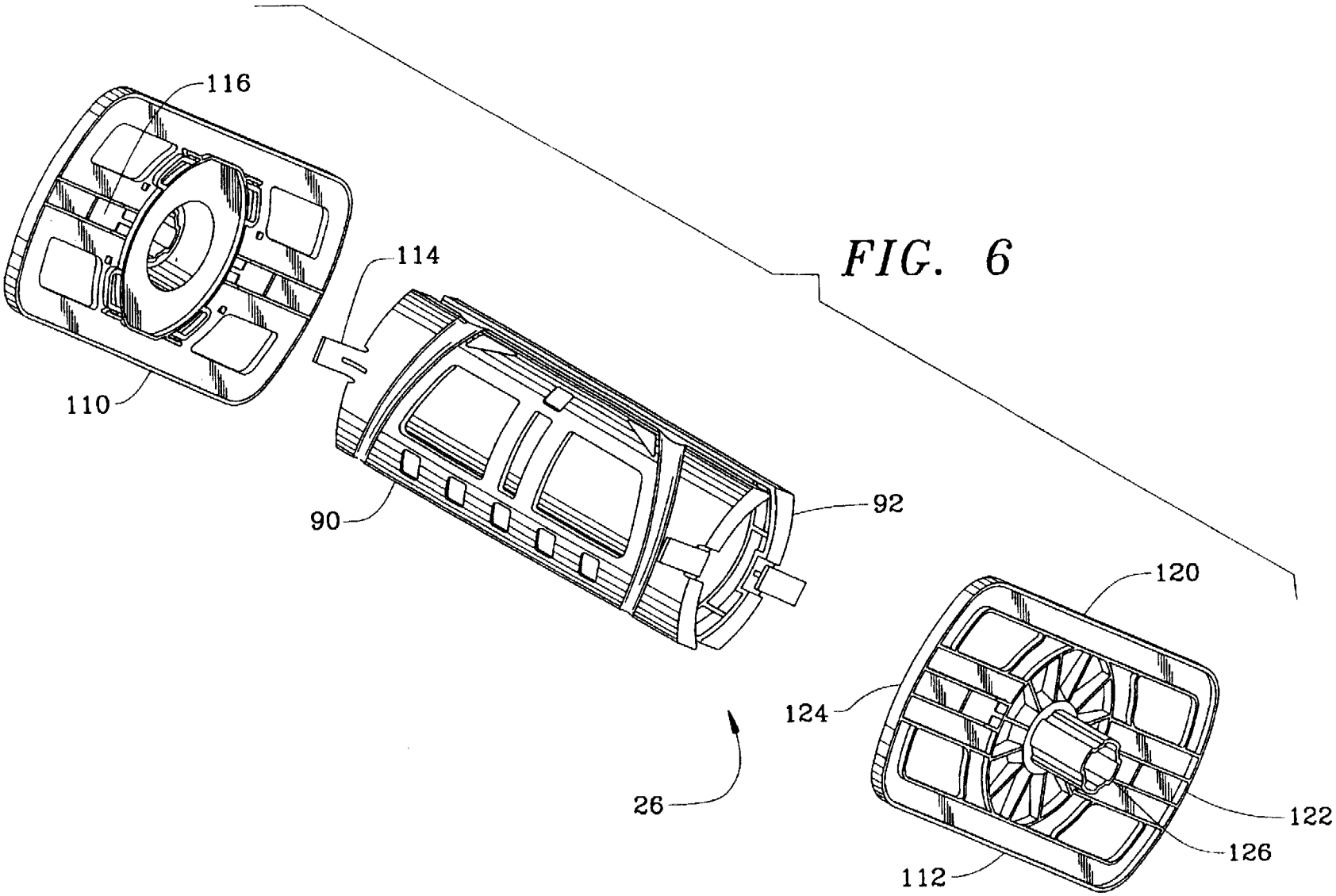
FIG. 6 is an exploded view of the reel assembly.

Referring again to FIGS. 2 and 3, and FIG. 6, reel 26 is made up of two identically molded cross braces which form reel halves 90 and 92 having approximately a twelve inch width with a pre-formed hose cavity 94 extending from a first edge 96 to a second edge 98. The cavity forms an inward slope from the first edge 96 of approximately a 0.63 inch radius $R_1$ about 2½ inches inward from side edge 104 to the second edge 98 wherein the cavity 94 is continuous across the surface of the reel and tapers to approximately a 0.3 inch radius $R_2$ placed inboard from side edge 104 about 1 inch. Openings 100 are of sufficient size to receive the hand of an operator allowing the operator to thread the female hose end connector of a hose 102 to the male outlet of the hub centrally disposed on the end of the hub found within the reel cavity.

Additionally, the separation of the two reel halves 90 and 92 further provide sufficient area allowing the operator to attach the end of a flexible hose to follow the cavity 94 on one side of the reel 90. It should be noted that each reel 90 and 92 have the aforementioned cavities place along each side edge allowing a single piece part application and further allowing the hose to be wrapped in either a clockwise or counter clockwise motion. Further, the winding of the hose can be made from left to right, or reversed, based upon consumer preference movement of the crank to the preferred hub.

Figure 7:
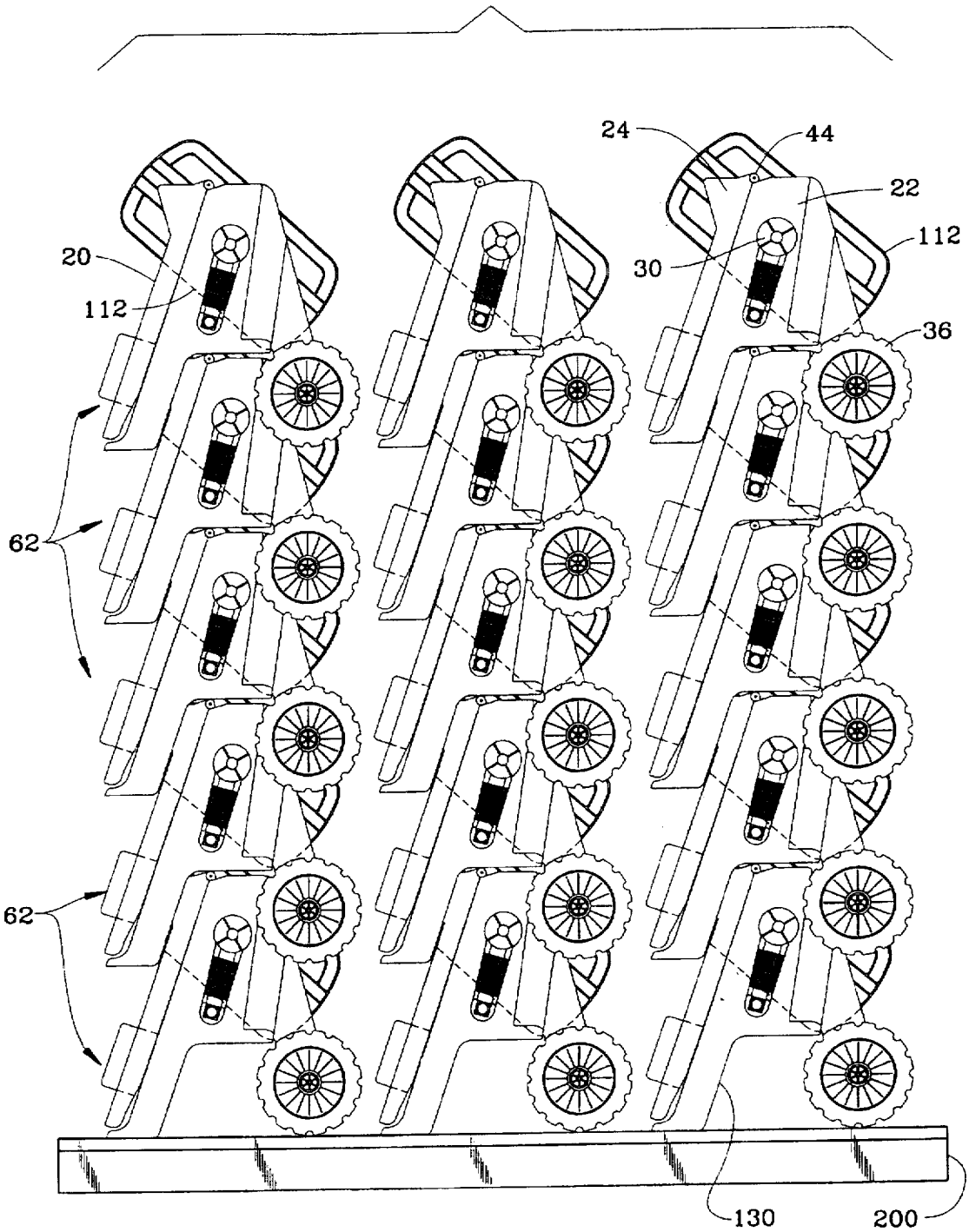
FIG. 7 is a pictorial side view of a plurality of hose carts illustrated in a nesting arrangement on a pallet.
Figure 8:
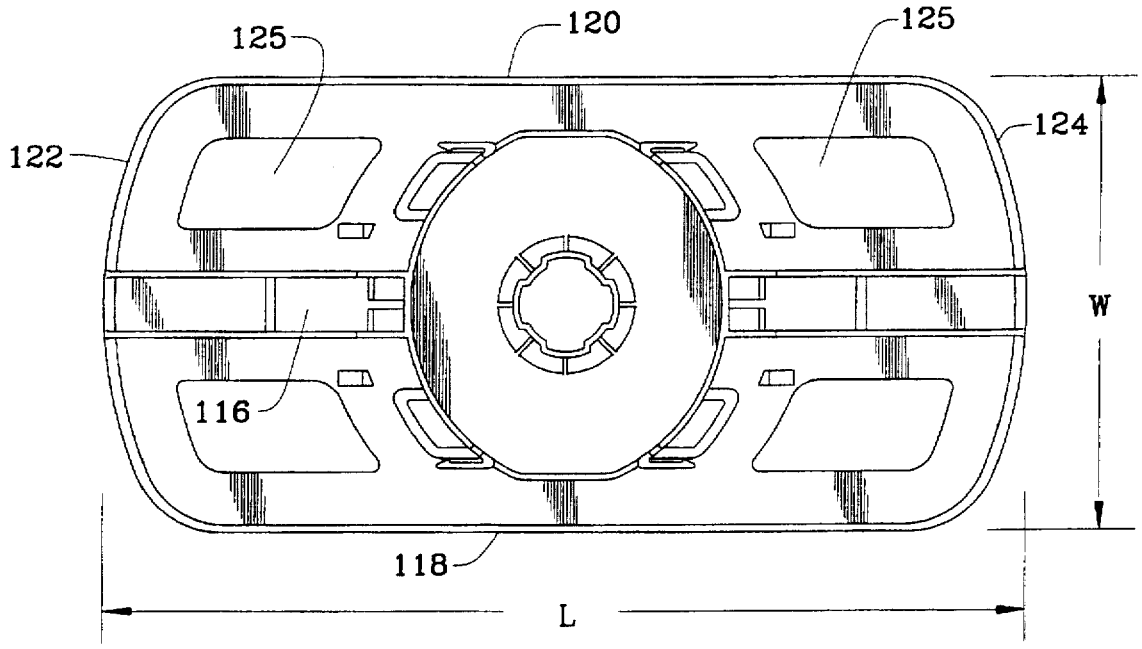
FIG. 8 is a side view of a reel flange.
Figure 9:
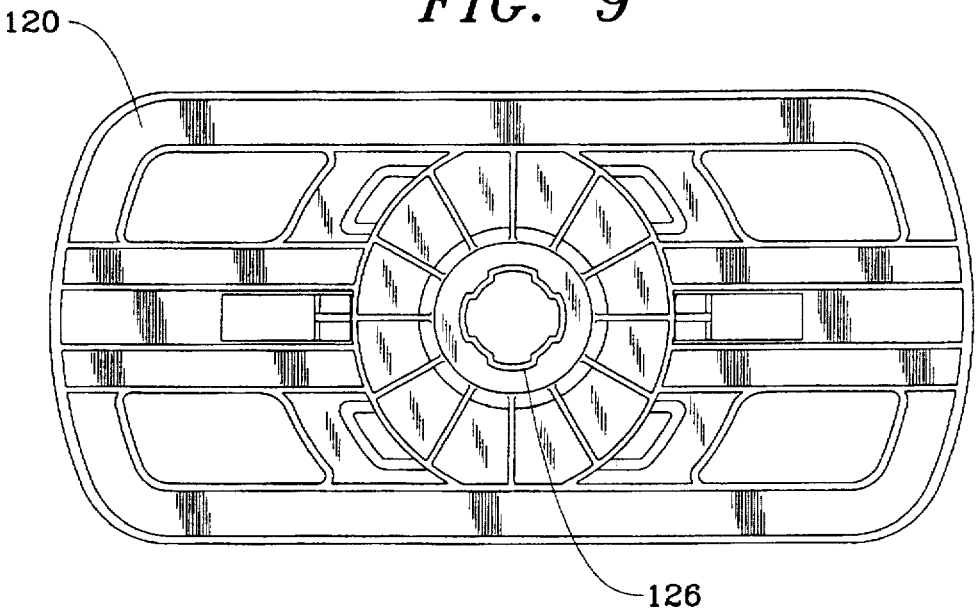
FIG. 9 is an outer side view of the reel flange.

Referring again to FIG. 6, the reel halves 90 and 92 are coupled to a pair of spaced apart reel flanges 110, 112 forming a spool upon assembly. Flange tabs 114 are insertable into flange opening 116 to secure the components in a fixed predetermined position of which the surface of the reel faces outwardly providing sufficient surface space for winding of a large or long flexible hose. Unique to the flanges 110 and 112 is the oblong shape wherein the shape is rectangular with rounded edges. The shape provides sufficient surface area for maintaining a flexible hose within the spool yet allows the ability to stack the frames. Reel flanges 110 and 112 as shown in FIGS. 8 and 9, are identical, each part having an oblong shape defined by a first side 118 and second side 120 and a first end 122 and a second end 124. Centrally disposed in each flange is a hub 126 which is insertable into journaled apertures located on the frame 22. The aperture is reinforced by ribs on the inner side of the frame providing reinforcement to the aperture without distracting from the aesthetic appearance of the frame. The ribs are hidden from view once the flanges are installed. The front side of the reel flange includes flange opening 116 disposed between parallel spaced apart support ribs, the opening 116 made available to secure the reel half in a fixed predetermined position. The flange oblong shape is rectangular having a length L of approximately 15 inches and a width W of approximately 7.5 inches. The shape is critical for nesting of like hose carts providing the instant invention with stackability. During storage, as shown by FIG. 7, each flange is set at an angle allowing compact stacking the angular placement of the nesting hose cart. The oblong shape has a first side 118 and second side 120 providing the length and a first end 122 and a second end 124 providing the width. The length and width meet with a curved corner. The inner surface of the hub employs four equal spaced indentations for receipt of hose coupler or crank. Plastic is removed from openings 125 to lessen the use of material in non-critical areas.

Figure 5A:
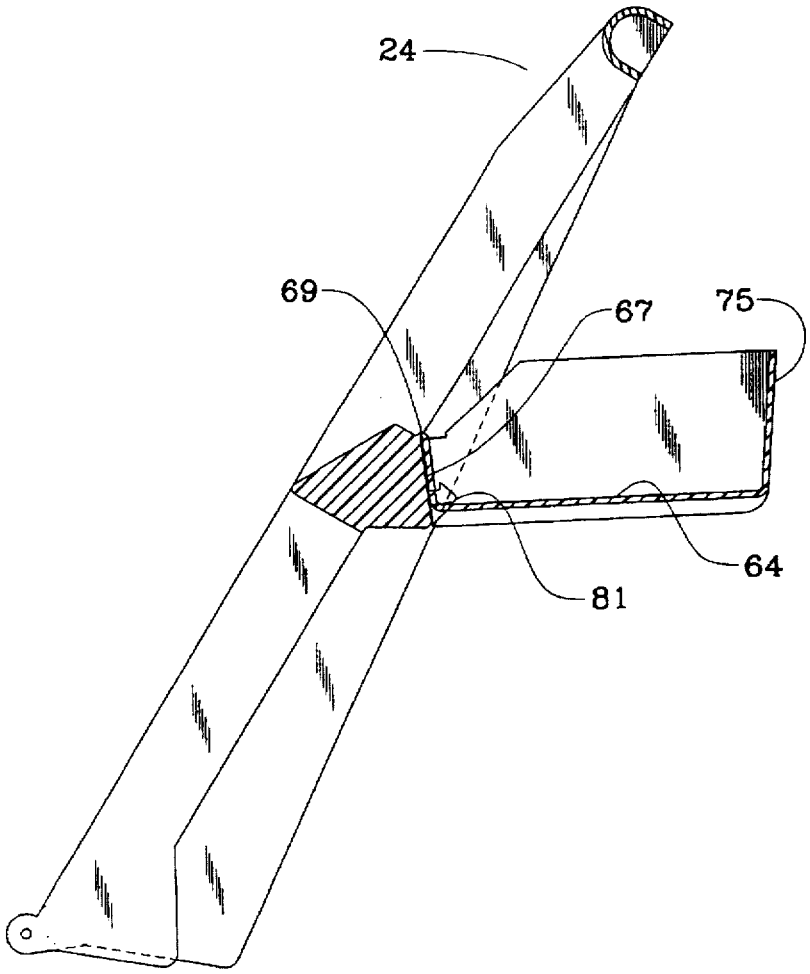
FIG. 5A is a side elevational view of the handle with the tray placed in an open position.

Now referring to FIGS. 5, and 5A the handle 24 of the hose reel has provisions for supporting of the integrated tray 62 by use of the living hinge 69 incorporated into support bracket 91 on the back side surface of the handle. The support bracket 91 includes latch 81 having a side surface 93 as shown and a frontal surface 95 curved to form a hook by use of angled surface 97 placed perpendicular to the corner of the surface. The support bracket 91 engages the side wall 67 when the tray 62 is placed in an open position wherein latch 81 engages the side surface 67 of the tray maintaining side wall 67 against surface 99 of support 91. The hinge 69 is pre-formed so as to allow rotation of the tray into the pre-defined position and once placed in a latched position further provides support for the weight of items placed therein. The base 64 of the tray 62 has a rear wall 75.

FIG. 7 is pictorial side view of a plurality of hose carts 20 illustrating the utility of the reel flanges 112 when the frames 22 are placed in a nesting position. As shown by way of illustration, the reel flanges 112 nest while in a stacked position. Hidden lines illustrate the angular direction of the reel flange 112. The handles 24 are folded at the pivot point 44 placing the handles in a storage position wherein bottom 130 of the frame can be situated on the top portion of a similar frame 22. Similarly, the wheels fit behind the frame so as not to interfere with the nesting. The crank 30 can be placed in a position in conjunction with the reel flanges so as not to interfere with the mounting frame, the crank having a folding handle as described in detail previously in the incorporated-by-reference U.S. Pat. No. 5,425,391. Tray 62 is shipped in a stored position so at to avoid interfering with any adjoining hose reel components.

The nesting feature allows for a plurality of preassembled portable hose carts 20 to be placed upon a skid or pallet 200 decreasing the amount of space necessary for storage and transportation thereby increasing the number of units that can be shipped per a given cubic volume of space. By preassembling the hose carts, the shipping cartons and assembly instructions can be eliminated. The nesting can be described as a method of storing hose apparatus for windably holding an elongated flexible garden hose, said method comprising: molding a single piece support frame having two inverted V-shaped frame sides, each frame side having a top surface and split legs depending therefrom forming a front leg and a rear leg, said frame sides formed integral with a front cross bar supporting said front legs and a rear cross bar supporting said rear legs, each frame side having a hub bearing surface disposed between said top surface and said split legs; securing a handle having a first leg pivotally connected to said top surface of one frame side and a second leg pivotally connected to said top surface of the second frame side, said handle storable juxtaposition to said frame side; said handle supporting a foldable storage tray which is pivotally attached to a bracket mounted to said handle; attaching a spool disposed between said frame sides, said spool having a plurality of cross-braces defining a reel surface for receipt of a flexible hose, said reel surface coupled between a first and second oblong shaped reel flange, each said reel flange having a centrally disposed hub operatively associated with each said frame side; inserting a hose connector comprising a hose male connector being adaptable for connection to flexible hose available for winding about the spool, a hose female adapter being adaptable for connection to an inlet hose, and a coupling sleeve, said hose male connector having at least one O-ring contacting the hose female adapter to form a seal therebetween, said hose connector releasably insertable through one of said hubs providing an inlet connection mounted in a fixed position on one side of a reel flange fluidly communicated to an outlet adapter on a second side of said flange; joining a crank releasably insertable through one of said hubs providing a direct coupling to said spool allowing rotation thereof, said crank including a handle pivotally attached to a the crank being positionable from a perpendicular position for hand operation to a raised position to facilitate storage; placing a pair of wheels journaled to each rear leg; and stacking the assembled hose cart on top of similarly assembled hose carts whereby said crank and said reel flanges are rotated allowing a lower portion of said frame sides to reside against an upper portion of similar shaped frame sides.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A method of storing hose storage apparatus for windably holding an elongated flexible garden hose, said method comprising:

molding a single piece support frame having two inverted V-shaped frame sides each, each said frame side having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs;

securing a handle having a first leg pivotally connected to said top surface of one said frame sid and a second leg pivotally connected to said top surface of said second frame side, said handle supporting a foldable storage tray which is pivotally attached to a bracket mounted to said handle sides, said handle storable juxtaposition to said frame side;

attaching a spool disposed between said frame sides, said spool having a plurality of cross-braces defining a reel surface for receipt of a flexible hose, said reel surface coupled between a first and second oblong shaped reel flange having a length and a width with said length greater than said width, each said reel flange having a centrally disposed hub operatively associated with each said frame side;

inserting a hose connector comprising a hose male connector being adaptable for connection to a flexible hose available for winding about said spool, a hose female connector being adaptable for connection to an inlet hose, and a coupling sleeve, said hose male connector having at least one O-ring contacting said hose female connector to form a seal therebetween, said hose connector releasably insertable through one of said hubs providing an inlet connection mounted in a fixed position on one side of a reel flange fluidly communicated to an outlet adapter on a second side of said flange;

joining a crank releasably insertable through one of said hubs providing a direct coupling to said spool allowing rotation thereof, said crank including a handle pivotally attached to said crank being positionable from a perpendicular position for hand operation to a raised position to facilitate storage;

placing a pair of wheels journaled to each rear leg; and stacking the assembled hose cart on top of similarly assembled hose carts whereby said crank and said reel flanges are rotated allowing a lower portion of said frame sides to reside against an upper portion of similar shaped frame sides.

2. A stackable hose storage apparatus for windably holding an elongated flexible garden hose comprising:

a single piece support frame defined by two frame sides each having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs;

a spool disposed between said frame sides, said spool having a plurality of cross-braces defining a reel surface for receipt of a flexible hose, said reel surface coupled between a first and second oblong shaped reel flange defined by a length and a width with said length greater than said width, each said reel flange having a centrally disposed hub operatively associated with each said frame side hub bearing surface;

a hose connector releasably insertable through one of said hubs providing an inlet connection mounted in a fixed position on one frame side, said frame side and through said reel flange fluidly communicated to an outlet adapter on a second side of said flange;

a pair of wheels journaled to each said rear leg; and a handle having a first arm pivotally connected to said top surface of one said frame side and a second arm pivotally connected to said top surface of said second frame side, said handle supporting a foldable storage tray which is pivotally attached to a bracket mounted to said handle sides;

wherein said handle folds over said single piece support frame and said reel flange rotates to an angular position allowing a fully assembled hose storage apparatus to be stacked in a nesting arrangement over a similar assembled hose storage apparatus.

3. The hose storage apparatus according to claim 2 wherein each said cross-braces are further defined as two semicircular brackets forming identical reel surface halves.

4. The hose storage apparatus according to claim 3 wherein each said reel surface includes at least one hose relief cavity comprising an inward slope depending from a first edge of said reel surface having a first depth set a first distance from an end of said reel surface to a second edge of said reel surface at a depth less than said first depth and set a second distance from said first end of said reel surface.

5. The hose storage apparatus according to claim 3 wherein each said reel surface includes at least one aperture of sufficient size to permit a human hand to reach through whereby said aperture allows an operator to couple a free end of a flexible hose to said hose connector.

6. The hose reel storage apparatus according to claim 2 wherein said handle is constructed of moldable plastic material and pivotally attached to said frame being positionable from an upright position to a lowered position to facilitate storage of the storage apparatus, said handle having a locking mechanism secured to each said arm of said handle for releasably securing said handle to said top portion of each said frame side.

7. The hose storage apparatus according to claim 6 wherein said locking mechanism is concealed within an enlarged portion of each said arm of said handle, said locking mechanism engagable with said top portion of each said frame side.

8. The hose storage apparatus according to claim 2 wherein said hose connector includes: a hose male connector being adaptable for connection to flexible hose available for winding about the spool, a hose female adapter being adaptable for connection to an inlet hose, and a coupling sleeve, said hose male connector having at least one O-ring contacting the hose female adapter to form a seal therebetween.

9. The hose storage apparatus according to claim 8 wherein said coupling sleeve is further defined as a plurality of inwardly biased tabs available for locking said hose male connector to said hose female connector, said tabs operatively associated with said hose female connector.

10. The hose storage apparatus according to claim 9 wherein said tabs are removed from a biased position with said hose female connector by pulling said coupling sleeve away from said female hose connector.

11. The hose storage apparatus according to claim 2 wherein said crank includes said handle that is constructed of moldable plastic material and securable to said hub, said crank including a handle pivotally attached to a shank of said crank being positionable from a perpendicular position for rotation to a raised position to facilitate storage of the storage apparatus, said handle frictionally engaging said shank for holding in the raised position.

12. The hose storage apparatus according to claim 11 wherein said crank can be placed in either hub allowing said crank to operate in a left hand or right hand position.

13. The hose storage apparatus according to claim 2 wherein said frame is constructed from a single piece of plastic further defining each said frame side by inverted V-shaped structures having a flattened top portion and split legs depending therefrom, said frame positionable on another frame allowing a nesting arrangement.

14. The hose storage apparatus according to claim 2 wherein said handle includes a cross brace providing a slot for maintaining a free end of a flexible hose in an upright position.

15. The hose storage apparatus according to claim 2 wherein said first and second oblong shaped reel flange includes a means for coupling two of said cross-braces in a fixed diametrically opposed position.

16. The hose storage apparatus according to claim 15 wherein each said oblong shaped reel flange is further defined as having a length of approximately 15 inches and a width of approximately 7.5 inches.

17. The hose storage apparatus according to claim 2 wherein each said oblong shaped reel flange hub includes four equal spaced indentations operatively associated with spaced apart engagement tabs of said crank.

18. The hose storage apparatus according to claim 2 wherein each said oblong shaped reel flange hub includes four equal spaced indentations operatively associated with spaced apart engagement tabs of said hose coupler.

19. The hose storage apparatus according to claim 2 wherein each said oblong shaped reel flange hub includes a flat front surface proximal to a centrally disposed aperture and a ribbed back surface providing support for an elongated extension of said aperture.

20. A stackable hose storage apparatus for windably holding an elongated flexible garden hose comprising:

a single piece support frame having two inverted V-shaped frame sides, each said frame side having a top surface and split legs depending therefrom forming a front leg and a rear leg, said frame sides formed integral with a front cross bar supporting said front legs and a rear cross bar supporting said rear legs, each said frame side having a hub bearing surface disposed between said top surface and said split legs;

a spool disposed between said frame sides, said spool having a plurality of cross-braces defining a reel surface for receipt of a flexible hose, said reel surface coupled between a first and second oblong shaped reel flange having a length and a width with said length greater than said width, each said reel flange having a centrally disposed hub operatively associated with each said frame side;

a hose connector comprising a hose male connector being adaptable for connection to flexible hose available for winding about said spool, a hose female connector being adaptable for connection to an inlet hose, and a coupling sleeve, said hose male connector having at least one O-ring contacting said hose female connector to form a seal therebetween, said hose connector releasably insertable through one of said hubs providing an inlet connection mounted in a fixed position on one side of a said reel flange fluidly communicated to an outlet adapter on a second side of said flange;

a crank releasably insertable through one of said hubs providing a direct coupling to said spool allowing rotation thereof, said crank including a crank handle pivotally attached to said crank being positionable from a perpendicular position for hand operation to a raised position to facilitate storage;

a pair of wheels journaled to each rear leg; and a handle having a first arm pivotally connected to said top surface of one said frame side and a second arm pivotally connected to said top surface of said second frame side, said handle supporting a foldable storage tray which is pivotally attached to a bracket mounted to said handle sides;

wherein said handle folds over said single piece support frame and said reel flange rotates to an angular position allowing a fully assembled hose storage apparatus to be stacked in a nesting arrangement over a similar assembled hose storage apparatus.

21. The hose storage apparatus according to claim 20 wherein said coupling sleeve is further defined as a plurality of inwardly biased tabs available for locking said hose male connector to said hose female connector, said tabs operatively associated with said hose female connector.

22. The hose storage apparatus according to claim 21 wherein said tabs are removed from a biased position with said hose female connector by pulling said coupling sleeve away from said female hose connector.

23. The hose storage apparatus according to claim 20 wherein said handle of said crank maintained in a raised position by frictional engagement.

24. The hose storage apparatus according to claim 20 wherein said cross brace defines a plurality of cavities of sufficient angular shape so as to allow a flexible hose to couple to said female coupling at an angle providing a gradual slope for relief of hose stress upon coupling of the flexible hose to a said male hose connector.

25. The hose storage apparatus according to claim 24 wherein said cavities allow directional placement of a flexible hose whereby the flexible hose can be wound about said spool of the apparatus in a clockwise or counter clockwise direction.

* * * * *